US011081263B2

(12) United States Patent
Iwamura et al.

(10) Patent No.: US 11,081,263 B2
(45) Date of Patent: Aug. 3, 2021

(54) CHIP-SHAPED ELECTRONIC COMPONENT

(71) Applicants: PELNOX, LTD., Kanagawa (JP); Panasonic Intellectual Property Management Co., Ltd., Osaka (JP)

(72) Inventors: Eiji Iwamura, Kanagawa (JP); Yuichi Ishii, Kanagawa (JP); Hirokatsu Itou, Osaka (JP); Naohiro Takashima, Osaka (JP); Ken Kasashima, Osaka (JP)

(73) Assignees: PELNOX, LTD., Kanagawa (JP); PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 6 days.

(21) Appl. No.: 16/496,930

(22) PCT Filed: Dec. 18, 2018

(86) PCT No.: PCT/JP2018/046661
§ 371 (c)(1),
(2) Date: Sep. 23, 2019

(87) PCT Pub. No.: WO2019/131352
PCT Pub. Date: Jul. 4, 2019

(65) Prior Publication Data

US 2020/0126695 A1 Apr. 23, 2020

(30) Foreign Application Priority Data

Dec. 25, 2017 (JP) ..... JP2017-247249

(51) Int. Cl.
*H01C 1/14* (2006.01)
*H01C 1/01* (2006.01)
*H01C 17/00* (2006.01)

(52) U.S. Cl.
CPC ..... *H01C 1/14* (2013.01); *H01C 1/01* (2013.01); *H01C 17/006* (2013.01)

(58) Field of Classification Search
CPC ..... H01C 1/14; H01C 1/01; H01C 17/006
(Continued)

(56) References Cited

U.S. PATENT DOCUMENTS

2009/0134361 A1* 5/2009 Takashima ..... H01C 17/006 252/503

FOREIGN PATENT DOCUMENTS

JP H4-257211 9/1992
JP 2004-111057 A 4/2004
(Continued)

OTHER PUBLICATIONS

Chinese Office Action with English Translation, dated Apr. 30, 2021, for corresponding Chinese Application No. 201880005499.1, 14 pages.

*Primary Examiner* — Edwin A. Leon
*Assistant Examiner* — Iman Malakooti
(74) *Attorney, Agent, or Firm* — Seed IP Law Group LLP

(57) ABSTRACT

One chip-shaped electronic component 100 of the present invention has a substrate 10, and a termination electrode layer 80 formed on an end face of the substrate 10. The termination electrode layer 80 is made of a mixed material that contains an electrically-conductive substance (a') (containing carbon (a) as one type of the electrically-conductive substance (a')), whisker-like particles (b) covered with the electrically-conductive substance (a'), flake-like particles (c) having electroconductivity, and a tetrafunctional hydroxyphenyl type epoxy resin (d) having a molecular weight of 450 or more and less than 800. In addition, a mass ratio of the flake-like particles (c) is 3/7 or more and 9 or less when the whisker-like particles (b) is assumed to be 1.

16 Claims, 3 Drawing Sheets

(58) Field of Classification Search
USPC ..... 338/322
See application file for complete search history.

(56) References Cited

FOREIGN PATENT DOCUMENTS

| | | | | |
|---|---|---|---|---|
| JP | 2010-108845 | * | 5/2010 | ..... H01B 1/22 |
| JP | 2010-108845 A | | 5/2010 | |
| WO | 2007/032201 A1 | | 3/2007 | |

* cited by examiner

[Fig. 1]
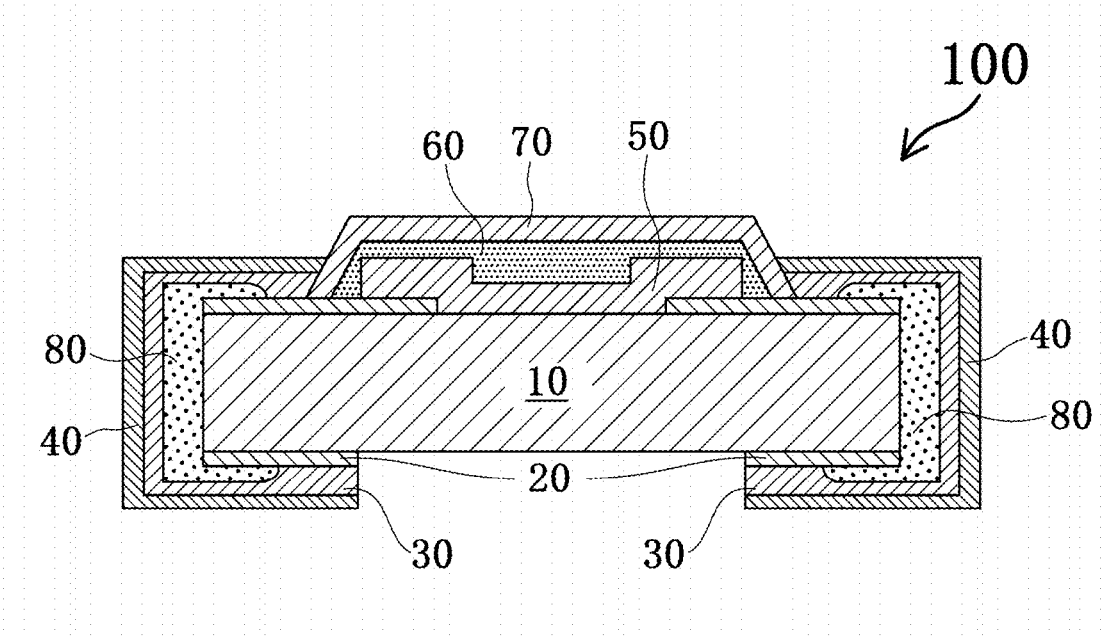
[Fig. 2A]
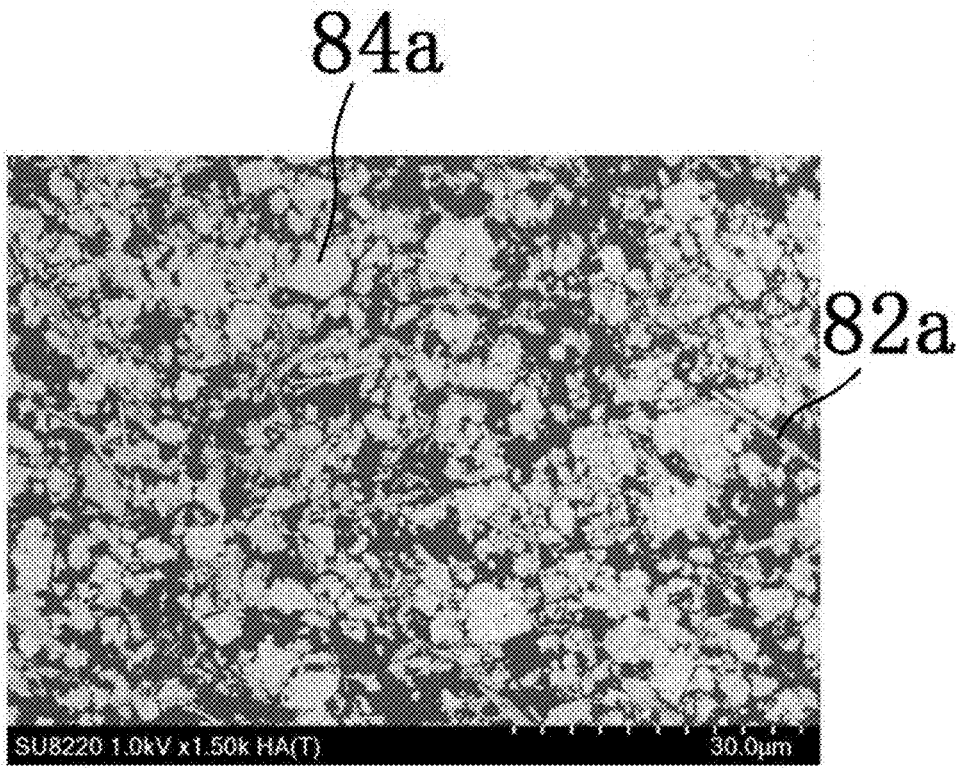

[Fig. 2B]
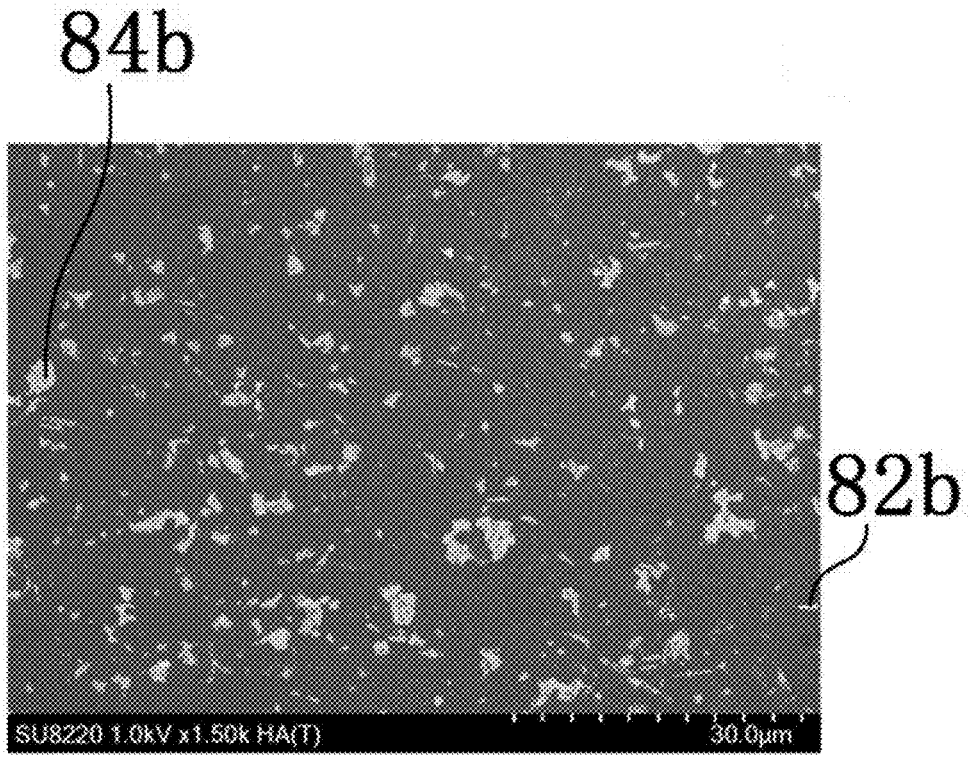
[Fig. 3]
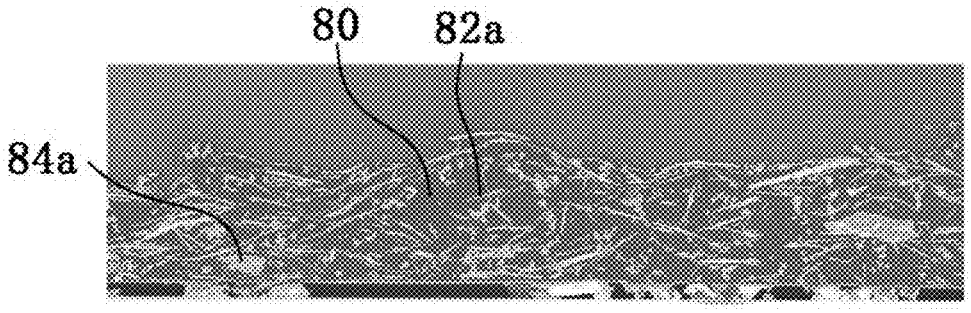

[Fig. 4]
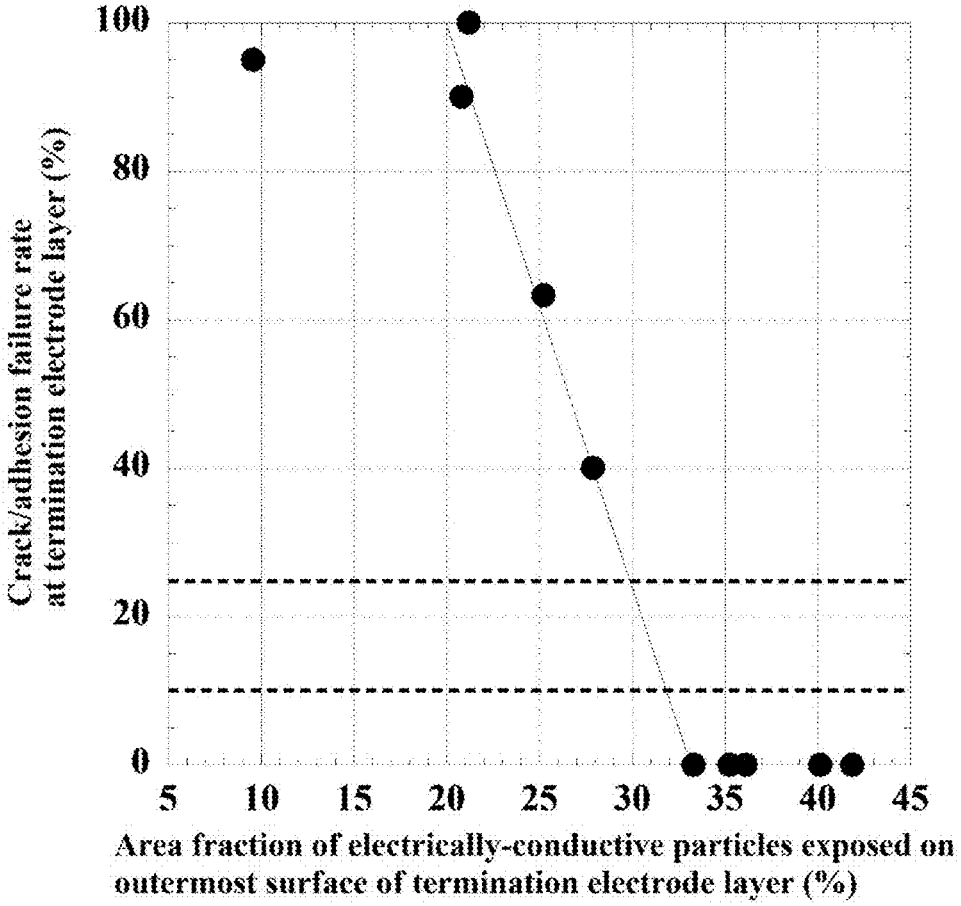
[Fig. 5]
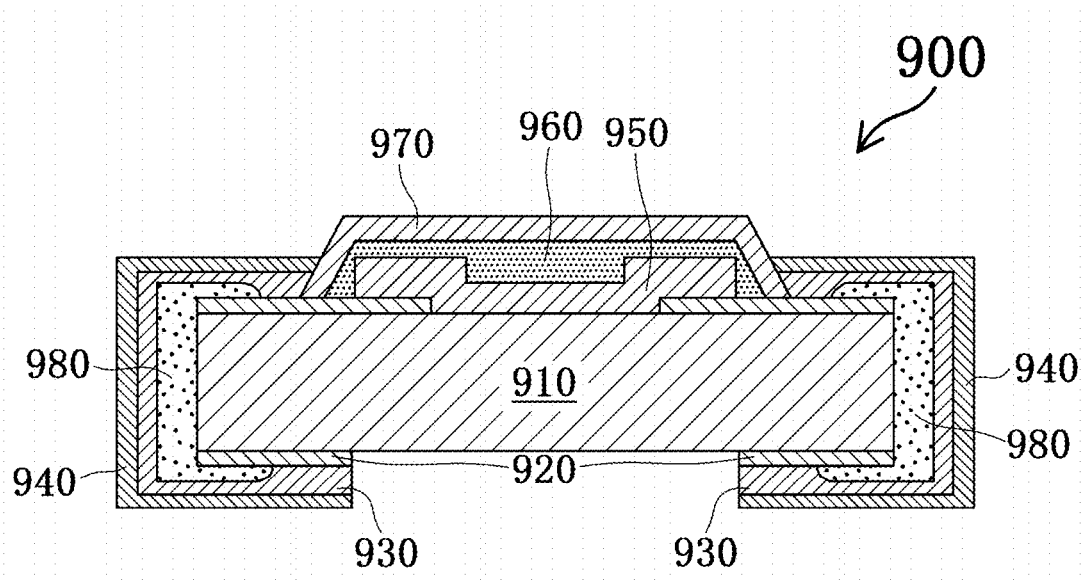

CHIP-SHAPED ELECTRONIC COMPONENT

TECHNICAL FIELD

The present invention relates to a chip-shaped electronic component.

BACKGROUND ART

Technical issues related to electrical appliances have been more and more sophisticated with recent growing demands for downsizing, higher efficiency and higher power output of electrical appliances. For example, a chip-shaped electronic component, which is bonded through solder to a metal electrode formed on a rigid substrate, is expected to be durable during solder bonding processes or usage in a high-temperature environment.

As illustrated in FIG. 5, a common chip resistor 900 has a resistive element 950 formed on a ceramic substrate (representatively, made of alumina) 910, a glass material layer 960 that covers the resistive element 950, and a protective film 970 that covers the glass material layer 960. The chip resistor 900 additionally has a metal electrode layer 920 that is formed partially on a top face, partially on a bottom face and end faces (side faces) of the ceramic substrate (representatively, made of alumina) 910 and is electrically connected to the resistive element 950, and a nickel plated layer 930 and a tin plated layer 940 that are electrically and mechanically bonded to the metal electrode layer 920. In some cases, a resin electrode layer 980 that contains electrically-conductive fine particles may be interposed between the metal electrode layer 920 and the nickel plated layer 930 (Patent Document 1). Moreover, there is disclosed an electrically-conductive paste used for the resin electrode layer 980, which is capable of achieving high electroconductivity despite a low content of silver powder in the electrically-conductive paste. (Patent Document 2).

In a case where the chip-type resistor, whose electrodes are formed only from metals without the use of the resin electrode layer, is surface-mounted on the substrate and used under the aforementioned high-temperature environment, under temperature cycle load, or under mechanical load, cracks may propagate not only through an electrode region where the individual layers are stacked, but also through the ceramic substrate (representatively, made of alumina) 910, or through a solder metal part that bonds the substrate and the chip-type resistor. The cracks may degrade electrical characteristics of the chip resistor.

PRIOR ART DOCUMENTS

Patent Documents

Patent Document 1: Japanese Patent Laid-open Publication No. 4-257211

Patent Document 2: Japanese Patent Laid-open Publication No. 2004-111057

SUMMARY OF THE INVENTION

Problems to be Solved by the Invention

As described above, there are growing demands for higher durability of the chip-shaped electronic component against high temperatures or load of temperature change. For example, a chip-shaped electronic component, which is bonded through solder to a metal electrode formed on a rigid substrate such as a glass fiber-reinforced epoxy resin substrate, is required to be durable against a high-temperature (representatively, more than 200° C.) environment during solder bonding processes. In these days, the chip-shaped electronic component applied to vehicles is required to be durable against a temperature cycle between −50° C. and 150° C., which corresponds to GO grade specified in AEC (Automotive Electronics Council)-Q200 for all passive parts applied to electrical equipment, and against repetitive mechanical vibration during use.

Even with use of the aforementioned resin electrode layer which is expected to act as a buffer against the temperature or mechanical load, the chip-shaped electronic component, which is capable of keeping high reliability even under harsh environments regarding temperature and mechanical load, is however still in the middle of research and development.

Solutions to the Problems

The present invention can largely contribute to realize a chip-shaped electronic component with a resin electrode layer, which is capable of keeping high reliability even under harsh environments, by solving at least one technical problem described above.

The present inventors found through extensive researches and analyses that at least a part of the aforementioned technical problems can be solved by forming, as a part of a termination electrode layer, a resin electrode layer that contains electrically-conductive fine particles between a metal electrode layer and an electroplated layer, if the termination electrode layer has the characteristics below:

(a) the termination electrode layer has electroconductivity, adequate rigidity, and adequate flexibility;

(b) a base resin that excels in thermal decomposition resistance is selected;

(c) a plurality of different types of electrically-conductive fine particles are mixed in an appropriate ratio; and (d) a capability of demonstrating a sufficient level of electroconductivity, without adversely affecting performance of the chip-shaped electronic component, as a result of mixing such appropriate types of resin and electrically-conductive fine particles.

On the basis of such findings, the present inventors further went through researches, analyses, and trial-and-errors. The present inventors consequently found that the aforementioned characteristics (a) to (c) can be satisfied by employing a specific low molecular weight epoxy resin, a special curing agent, and specific electrically-conductive fine particles. More specifically, the specific epoxy resin found out by the present inventors, which excels in thermal decomposition resistance despite its low molecular weight, can serve as a base resin that has not only adequate rigidity under a relatively high temperature environment but also flexibility under a relatively low temperature environment, when combined with a special curing agent.

Choice of the low molecular weight epoxy resin component enables the electrically-conductive fine particles to expose on the surface of a coating film during curing, and this can enhance mechanical strength of the interface with the metal electrode layer, and can achieve high durability against harsh environments regarding temperature and mechanical load. In addition, by employing mixing of whisker-like particles with flake-like particles as the electrically-conductive fine particles in an appropriate ratio, and mixing of an appropriate type of base resin with such electrically-conductive fine particle, a chip-shaped electronic component with the resin electrode layer (termination electrode layer) capable of demonstrating high reliabilities (x) and (y) below was achieved. The present invention was created based on the aforementioned viewpoints.

(x) The resin electrode layer is prevented from being internally fractured, even under harsh environments, while retaining electroconductivity effective enough for the resin electrode layer.

(y) High adhesion strength with the substrate or the nickel-plated electrode layer is kept even under a relatively high temperature environment, thus preventing interfacial fracture.

One chip-shaped electronic component of the present invention has a substrate, and a termination electrode layer formed on an end face of the substrate. In the chip-shaped electronic component, the termination electrode layer is made of a mixed material that contains an electrically-conductive substance (a') (containing carbon (a) as one type of the electrically-conductive substance (a')), whisker-like particles (b) covered with the electrically-conductive substance (a'), flake-like particles (c) having electroconductivity, and a tetrafunctional hydroxyphenyl type epoxy resin (d) having a molecular weight of 450 or more and less than 800. In addition, in the chip-shaped electronic component, the mass ratio of the flake-like particles (c) is 3/7 or more and 9 or less when the whisker-like particles (b) is assumed to be 1.

With use of the chip-shaped electronic component, the termination electrode layer (resin electrode layer) may be suppressed from thermally decomposing, so that it becomes possible to suppress or prevent generation of voids and/or delamination of the termination electrode layer from the electroplated layer or the alumina substrate, under load applied during solder bonding processes or heat cycle load, with a high degree of certainty. This is attributable to the action of the "electrically-conductive particles" that contribute to keep high electroconductivity and can remain adhesive to the underlying ceramic substrate or the overlying plated metal as well as the "resin component" that is chemically and mechanically stable even under a high-temperature environment, and is harmonized between mechanical rigidity enough to endure impact or large deformation load, and flexibility enough to properly deform under repetitive stress load so as to prevent fracture. In addition, with use of one chip-shaped electronic component of the present invention, the termination electrode layer and the electroplated layer or the alumina substrate may have high adhesive force even under high temperatures, so that the chip-shaped electronic component, having a solder bonded part, may be prevented from being fractured under thermal shock or thermal fatigue resulting from repetitive switch between a low-temperature state and a high-temperature state.

By the way, "film" in the present application may be referred to as "layer". Hence, the notation "film" in the present application is used to cover "layer", and the notation "layer" is used to cover "film".

Effects of the Invention

With use of one chip-shaped electronic component of the present invention, it becomes possible to suppress or prevent generation of voids and/or delamination between the termination electrode layer and the electroplated layer or the alumina substrate, under load applied during solder bonding processes or heat cycle, with a high degree of certainty. In addition, with use of one chip-shaped electronic component of the present invention, the termination electrode layer and the electroplated layer or the alumina substrate may have high adhesive force even under high temperatures, so that the chip-shaped electronic component, having a solder bonded part, may be prevented from being fractured under thermal shock or thermal fatigue resulting from repetitive switch between a low-temperature state and a high-temperature state, with a high degree of certainty.

BRIEF DESCRIPTION OF THE DRAWINGS

FIG. 1 is a schematic cross-sectional view illustrating a chip resistor 100 of this embodiment.

FIG. 2A is an SEM image of a termination electrode layer (a layer made of a mixed material) of a first embodiment, seen in a 0.075 mm×0.057 mm randomly selected area of the termination electrode layer in a plan view, when the termination electrode layer is observed at a magnification of 1500.

FIG. 2B is an SEM image of the termination electrode layer (a layer made of a mixed material) of Comparative Example 6, seen in a 0.075 mm×0.057 mm randomly selected area of the termination electrode layer in a plan view, when the termination electrode layer is observed at a magnification of 1500.

FIG. 3 is a cross-sectional SEM image of the termination electrode layer (a layer made of a mixed material) of the first embodiment, seen in a 0.125 mm×0.034 mm randomly selected area of the termination electrode layer, when the termination electrode layer is observed at a magnification of 1000.

FIG. 4 is a graph illustrating a (cohesive) fracture frequency at an interface between an electroplated layer or a ceramic substrate and the termination electrode layer, or inside the termination electrode layer in the chip resistor, plotted versus total area fraction of whisker-like particles and flake-like particles that expose on the outermost surface of the termination electrode layer of the first embodiment.

FIG. 5 is a schematic cross-sectional view illustrating a conventional chip resistor.

DESCRIPTION OF REFERENCE SIGNS

10, 910: Substrate
20, 920: Metal electrode layer
30, 930: Nickel plated layer
40, 940: Tin plated layer
50, 950: Resistive element
60, 960: Glass material layer
70, 970: Protective film
80, 980: Termination electrode layer
82*a*, 82*b*: Whisker-like particle
84*a*, 84*b*: Flake-like particle
100, 900: Chip resistor

EMBODIMENT OF THE INVENTION

Paragraphs below will detail a chip resistor 100 as one example of the chip-shaped electronic component according to an embodiment of the present invention, and an exemplary termination electrode layer 80 that composes a part of the chip resistor 100 and is made of a mixed material.

First Embodiment

FIG. 1 is a schematic cross-sectional view illustrating a chip resistor 100 of this embodiment. The chip resistor 100 has a resistive element 50 formed on an alumina substrate 10, a glass material layer 60 that covers the resistive element 50, and a protective film 70 that covers the glass material layer 60. The chip resistor 100 additionally has a metal electrode layer 20 that is formed partially on a top face and partially on a bottom face of the alumina substrate 10 and is electrically connected to the resistive element 50, and a nickel plated layer 30 and a tin plated layer 40 that are electrically and mechanically bonded to the metal electrode layer 20. On the end face of the alumina substrate 10, formed is a termination electrode layer 80 that is electrically connected to the metal electrode layer 20. On the end faces of the alumina substrate 10, the nickel plated layer and the tin plated layer cover the termination electrode layer 80.

The termination electrode layer 80 of this embodiment is made of a mixed material that contains an electrically-conductive substance (a') (containing carbon (a) as one type of the electrically-conductive substance (a')), whisker-like particles (b) covered with the electrically-conductive substance (a'), flake-like particles (c) having electroconductivity, and a tetrafunctional hydroxyphenyl type epoxy resin (d), having a molecular weight of 450 or more and less than 800.

In addition, in the chip resistor 100 of this embodiment, the mass ratio of the flake-like particles (c) is 3/7 or more and 9 or less when the whisker-like particles (b) is assumed to be 1.

Next, the mixed material used for forming the termination electrode layer 80 will further be detailed.

The electrically-conductive substance (a'), as one of the constituents composing the mixed material of this embodiment, contains carbon (a). The carbon (a) is particularly a carbon powder having a surface area per gram of 800 $m^2$ or more. The electrically-conductive substance (a') may further contain, besides the carbon (a), at least one substance selected from the group consisting of Ag, Cu, Ni, Sn, Au, Pt and solder (representatively, but not restrictively, Sn-3Ag-0.5Cu alloy).

The whisker-like particles (b), as another constituent of the mixed material, covered with the electrically-conductive substance (a') is representatively a whisker-like inorganic filler (potassium titanate, for example) covered with a film of silver as an exemplary electrically-conductive substance. The inorganic filler, when being potassium titanate, typically has an average fiber diameter of 0.3 to 0.6 μm, an average fiber length of 5 to 30 μm, and an aspect ratio of 8.3 to 100. Moreover, whisker-like potassium titanate, covered with a film of any other electrically-conductive substance capable of demonstrating the effect of this embodiment, may be another employable aspect.

The flake-like particles (c) having electroconductivity, which are another constituent of the mixed material, are representatively a product obtained by subjecting spherical silver particles to plastic working using a ball mill or the like. While the shape and size of the flake-like particles (c) are not specifically limited, the flake-like particles (c) typically have an aspect ratio of 2 or more. The flake-like particles (c) may occasionally be referred to as tabular particles or scaly particles. As a substitute for the aforementioned silver particles, employable is a powder of silver alloy, copper alloy, and/or nickel alloy. Additionally employable is a flake-like electrically-conductive powder made of a silver, copper, nickel, or copper alloy core whose surface is coated with silver by plating or the like.

The tetrafunctional hydroxyphenyl type epoxy resin (d), having a molecular weight of 450 or more and less than 800, which is another mixed material, is representatively an epoxy resin represented by the chemical formula below. The epoxy resin (d) of this embodiment, based on its small molecular weight, can form a rigid, flexible, and highly durable network polymer, when combined with an appropriate crosslinkable curing agent. As a consequence, the epoxy resin (d) will have thermal stability and adequate deformability while preventing inter-molecular slippage, making it possible to play a role of a base resin that excels in durability against stress relaxation or fatigue fracture, and in thermal decomposition resistance. Moreover, the epoxy resin (d) may demonstrate adequate rigidity and adequate flexibility also under a low-temperature condition of −50° C. or less, or under a high-temperature condition more than 150° C.

[Chemical Formula 1]

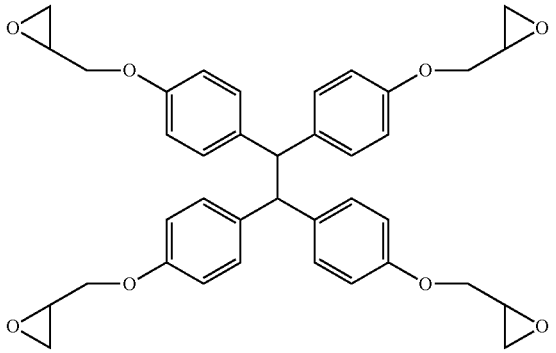

The mixed material can demonstrate suitable performance by further containing a curing agent (e) and a curing catalyst (f). Representative examples of the curing agent (e) include an imidazole-based curing agent (excluding those having a triazine skeleton) with an activation start temperature of 110° C. or more, and/or dicyandiamide. Representative examples of the imidazole-based curing agent include phenyl imidazole and cyanoimidazole. Examples of the curing catalyst (f) include tin (Sn)-based curing catalysts represented by dioctyltin dilaurate and stannous 2-ethylhexanoate, and phosphorus (P)-based curing catalysts represented by triphenylphosphine and tri(p-tolyl)phosphine. The imidazole-based curing agent and dicyandiamide, when allowed to coexist, demonstrate an effect of mutually accelerating the curing.

One suitable aspect is such that the mixed material further contains an adhesiveness enhancing agent such as a silane coupling agent, benzotriazole, and/or various metal chelating substances, for the purpose of enhancing adhesiveness between the substrate or the metal with the resin. Another suitable aspect is such that the mixed material further contains any of various inorganic fine particles, for the purpose of controlling the viscoelastic characteristic of a pasty substance so as to improve coatability. Still another suitable aspect is such that the mixed material further contains an appropriate amount of a leveling agent such as a surfactant, for the purpose of improving smoothness of the surface of the termination electrode layer 80.

The mixed material that contains the aforementioned individual components is used in the form of a uniform pasty dispersion, after being subjected to a known kneading step using a kneader mixer, a planetary mixer, and/or a triple roll mill. The pasty mixed material may be applied by coating or printing, using any of known coating/transfer techniques such as dip transfer, roller transfer, stamp transfer, and screen printing, onto the end faces of the alumina substrate 10 so as to establish electrical connection with the metal electrode layer 20 possessed by the alumina substrate 10. The termination electrode layer 80 as illustrated in FIG. 1 is thus formed.

Thickness of the termination electrode layer 80, at the central part of the end face of the substrate in this case, is not specifically limited. The thickness on a representative 3216 size alumina substrate is about 25 μm to about 30 μm at maximum, meanwhile the thickness on a representative 1005 size alumina substrate is about 15 μm to about 20 μm at maximum. Hence, the termination electrode layer 80 is formed at least on the end faces of the alumina substrate 10. Any of known forming methods is employable, in order to form the nickel plated layer 30 and the tin plated layer 40 that are provided so as to be electrically and mechanically bonded with the metal electrode layer 20 which is in electrical connection with the resistive element 50, and so as to cover the metal electrode layer 20 or the termination electrode layer 80.

The mixed material that contains the aforementioned individual components is applied by coating or printing on the end faces of the alumina substrate 10 so as to be electrically connected to the metal electrode layer 20 possessed by the alumina substrate 10. The termination electrode layer 80 as illustrated in FIG. 1 is thus formed. Hence, the termination electrode layer 80 is formed at least on the end faces of the alumina substrate 10. Any of known forming methods is employable, in order to form the nickel plated layer 30 and the tin plated layer 40 that are provided so as to be electrically and mechanically bonded with the metal electrode layer 20 which is in electrical connection with the resistive element 50, and so as to cover the metal electrode layer 20 or the termination electrode layer 80.

By employing such structure of the chip resistor 100 of this embodiment, it becomes possible to realize a chip resistor having the resin electrode layer (termination electrode layer 80) having high reliability even under harsh environments. More specifically, the chip resistor 100 of this embodiment can suppress or prevent generation of voids and/or delamination between the termination electrode layer 80 and the electroplated layer (for example, the nickel plated layer 30) or the alumina substrate 10 caused by load applied during solder bonding processes or heat cycle load, with a high degree of certainty. In addition, the chip resistor 100 of this embodiment can have high adhesive force between the termination electrode layer 80 and the electroplated layer (for example, the nickel plated layer 30) or the alumina substrate 10, even under high temperatures.

While the termination electrode layer 80 in this embodiment is covered with the nickel plated layer 30 and the tin plated layer 40, the electrically-conductive layer that covers the termination electrode layer 80 is not limited to the nickel plated layer 30 and the tin plated layer 40. For example, the electrically-conductive layer that covers the termination electrode layer 80 may be a single layer or a multi-layer. Another employable aspect is such that a material composing the single layer or the multi-layer is at least one metal selected from copper (Cu), chromium (Cr), lead (Pb), zinc (Zn), indium (In), bismuth (Bi), gold (Au), silver (Ag), palladium (Pd), and platinum (Pt), or an alloy of these metals. A method for forming the electrically-conductive layer employable here may be any of known methods.

The present inventors found that, as a result of mixing of the whisker-like particles and the flake-like particles, which are the electrically-conductive fine particles, in an appropriate ratio represented by the aforementioned numerical range, the termination electrode layer 80 can exhibit high bondability to the overlying metal plated layer, while retaining electroconductivity. Such high bondability is obtainable presumably due to an adequate volume fraction of the resin component contained in the termination electrode layer 80, and an adequate degree of exposure of the electrically-conductive components to the outermost surface of the termination electrode layer 80. As a consequence, adequate rigidity and adequate flexibility of the termination electrode layer 80 may be achieved with a high degree of certainty. The shape of the electrically-conductive substance (a') is not specifically limited, so long as the technical effect obtainable by the appropriate mixing of the whisker-like particles and the flake-like particles will not be inhibited, and particles having, for example, a spherical shape may be used.

Such adequate rigidity of the termination electrode layer 80 is considered to contribute to improved mechanical durability of the termination electrode layer 80, against impact force of collision or fall, or repetitive load of vibration or the like, or against thermal stress when the termination electrode layer 80 is placed under thermal load. Meanwhile, such adequate flexibility of the termination electrode layer 80 is considered to make the termination electrode layer 80 capable of absorbing thermal strain that may be produced under repetitive exposure to both of a low-temperature state and high a high-temperature state, and of preventing a crack that may occur at around the termination electrode layer 80 from propagating into the termination electrode layer 80, and is therefore considered to contribute to improved durability of the chip-shaped electronic component (representatively, the chip resistor 100) as a whole. In addition, the mass ratio of the flake-like particles (c) is preferably controlled to 1 or more and 9 or less when the whisker-like particles (b) is assumed to be 1, from the viewpoint of preventing voids from being generated inside the termination electrode layer 80, and of achieving adequate rigidity and adequate flexibility of the termination electrode layer 80 with a higher degree of certainty, while retaining electroconductivity. In an additional viewpoint of coatability that makes the termination electrode layer 80 widely applicable to various methods for forming, the mass ratio of the flake-like particles (c) is more preferably 1 or more and 5 or less when the whisker-like particles (b) is assumed to be 1.

As a result of creation of a state in which the whisker-like particles (b) and/or the flake-like particles (c) are allowed to protrude or expose from the outermost surface of the termination electrode layer 80 (a layer made of the mixed material) so as to electrically connect the electroplated layer (for example, the nickel plated layer 30) possessed by the chip resistor 100 with the termination electrode layer 80, the termination electrode layer 80 is considered to demonstrate electroconductivity with a high degree of certainty, while preventing delamination between the termination electrode layer 80 and the nickel plated layer 30 or fracture even under harsh environments. The present inventors reached an idea that the aforementioned effect of this embodiment would be demonstrated with a higher degree of certainty, if the state of such protrusion or exposure could adequately be controlled.

More specifically, the present inventors minutely analyzed a micro-area of the termination electrode layer 80 by SEM (scanning electron microscopy).

FIG. 2A is an SEM image of the termination electrode layer 80 (a layer made of the mixed material) of this embodiment, seen in a 0.075 mm×0.057 mm randomly selected area of the termination electrode layer 80 in a plan view, when the termination electrode layer 80 is observed at a magnification of 1500. For reference, FIG. 2B shows an SEM image of the termination electrode layer (a layer made of a mixed material) of later-described Comparative Example 6, seen in a 0.075 mm×0.057 mm randomly selected area of the termination electrode layer in a plan view, when the termination electrode layer is observed at a magnification of 1500.

FIG. 3 is a cross-sectional SEM image of the termination electrode layer 80 (a layer made of the mixed material) of this embodiment, seen in a 0.125 mm×0.034 mm randomly selected area of the termination electrode layer 80, when the termination electrode layer 80 is observed at a magnification of 1000. FIG. 4 is a graph illustrating a (cohesive) fracture frequency at the interface between the electroplated layer or the ceramic substrate and the termination electrode layer, or inside the termination electrode layer in the chip resistor, plotted versus total area fraction of the whisker-like particles and the flake-like particles that expose on the outermost surface of the termination electrode layer.

From the results of researches and analyses regarding the micro-areas of the termination electrode layer 80 representatively illustrated in FIGS. 2A and 3, and from the results illustrated in FIG. 4, it was found that the effect of this embodiment is obtainable with a higher degree of certainty, when at least one of condition (X) or (Y) below is satisfied.

(X) When the termination electrode layer 80 (a layer made of the mixed material) of this embodiment is observed by SEM at a magnification of 1500, the termination electrode layer 80 includes a region in which the area fraction of a section where whisker-like particles (b) 82*a* and flake-like particles (c) 84*a* expose on an outermost surface of the termination electrode layer 80 is 30% or more seen in a 0.075 mm×0.057 mm randomly selected area of the termination electrode layer 80. From the viewpoint of suppressing or preventing the fracture with a higher degree of certainty, the area fraction is preferably 31.5% or more, and from the viewpoint of avoiding the fracture with an even higher degree of certainty, the termination electrode layer 80 includes a region in which the area fraction is 33.0% or more.

(Y) When the termination electrode layer 80 (a layer made of the mixed material) of this embodiment is observed by cross-sectional SEM at a magnification of 1000, the termination electrode layer 80 includes a region in which a spacing between contact points of the whisker-like particles (b) 82*a* or the flake-like particles (c) 84*a* exposed on the outermost surface of the termination electrode layer 80 and the nickel plated layer 30 included in the chip resistor 100 is 10 μm or less seen in a 0.125 mm×0.034 mm randomly selected area of the termination electrode layer 80.

Meanwhile, in a comparative example illustrated in FIG. 2B, the whisker-like particles (b) 82*b* and the flake-like particles (c) 84*b* are distributed sparsely, showing an obvious difference from FIG. 2A.

The present inventors then estimated the area fraction of the whisker-like particles 82*a* and the flake-like particles 82*b* on the aforementioned cross-sectional SEM image, and went into investigations and analyses regarding a relation of the area fraction with electroconductivity, adhesion strength and the like. It was consequently found out that one suitable aspect relates to a case where the termination electrode layer 80 (a layer made of the mixed material) of this embodiment has a volume fraction of the whisker-like particles (b) 82*a* and the flake-like particles (c) 84*a* of 7% or more and 25% or less. More specifically, with the volume fraction controlled within such numerical range, the termination electrode layer 80 will be able to contain an adequate volume fraction of resin component, and will allow the electrically-conductive component to adequately expose on the outermost surface of the termination electrode layer 80. The aforementioned range of volume fraction was therefore found to successfully enhance the adhesiveness/adhesion strength with the substrate and the metal electrode layer (including the electroplated layer) with a higher degree of certainty, while keeping high electroconductivity.

<Performance Evaluation of Chip Resistor and Termination Electrode Layer>

Various performance evaluations and the results of the chip resistor 100 and the termination electrode layer 80 of this embodiment will be described below.

1. Storage Modulus of Termination Electrode Layer

The present inventors evaluated temperature dependence of storage modulus (Pa) of samples of the termination electrode layer 80 (a layer made of the mixed material) of this embodiment, and samples of the mixed material of comparative examples, using a dynamic viscoelasticity meter (model: DMS6100, from Seiko Instruments, Inc.). Results of evaluation of storage modulus are shown in Tables 1A, 1B and 2.

From analysis of the results of evaluation of storage modulus, the termination electrode layer 80 was found to show a storage modulus of $10^7$ Pa or more and $10^{10}$ Pa or less (more restrictively, $10^7$ Pa or more and $10^9$ Pa or less), in the temperature range between −55° C. or more and 155° C. or less. It is worth mentioning that the termination electrode layers 80 with such low temperature dependence as shown in Tables 1A and 1B, in other words, the termination electrode layers 80 less susceptible to temperature change, were obtained. It was therefore confirmed that, with the storage modulus controlled to $10^7$ Pa or more and $10^{10}$ Pa or less (more restrictively, $10^7$ Pa or more and $10^9$ Pa or less), the termination electrode layer 80 can demonstrate mechanical characteristics suitably balanced between high rigidity and flexibility, with a higher degree of certainty.

2. 1 Mass % Loss Temperature of Termination Electrode Layer

The present inventors further made analysis on temperature at which samples of the aforementioned mixed material that composes the termination electrode layer 80 of this embodiment, and samples of the mixed materials of comparative examples will lose 1 mass % of their weight (1 mass % in resin equivalent) or decompose, when measured by thermogravimetry/differential thermal analysis. Results of evaluation of the loss temperature are shown in Tables 1A, 1B and 2.

More specifically, the samples of the mixed material representing the termination electrode layer 80 of this embodiment were subjected to thermogravimetry/differential thermal analysis (TG/DTA) using a thermogravimetry/differential thermal analyzer (model: TG/DTA6200, from Seiko Instruments, Inc.) in a nitrogen atmosphere within the temperature range from 25° C. to 320° C. and at a heating rate of 10° C./min. By the measurement, the temperature at which the samples will lose 1 mass %, in resin equivalent, of their weight, or decompose was measured.

As a consequence, with the 1 mass % loss temperature, in resin equivalent, controlled to 250° C. or more (more preferably 260° C. or more), the termination electrode layer 80 was found to prevent generation of voids inside, to prevent thermal degradation during solder bonding processes, and can therefore suppress or prevent delamination or fracture at around the interface or inside of the termination electrode layer with a higher degree of certainty. From this point of view, the higher the 1 mass % loss temperature, the better. On the other hand, most of highly heat resistant substances have high elastic modulus, and are susceptible to fracture even due to very small strain induced by heat, such feature being so-called brittleness. Suffice it to say, the upper limit value is, for example, 320° C. or less.

3. Solder Heat Resistance

For the evaluation, manufactured were 3216 size chip resistors 100 having the termination electrode layer 80 or the mixed materials of comparative examples. Each sample was produced by soldering the chip resistor 100 onto copper electrode pads disposed on a glass epoxy substrate, using Sn—Ag(3%)-Cu(0.5%) lead free solder (model: VAPY LF219, from Arakawa Chemical Industries, Ltd.) in a nitrogen atmosphere, at maximum temperatures of 300° C. and 270° C.

The thus soldered chip resistor 100 was cut in the longitudinal direction, and the cross section was observed using an optical microscope or by SEM so as to evaluate occurrence of crack, delamination or fracture, at the interface between the termination electrode layer and the substrate or the nickel plated layer, or inside the termination electrode layer 80. The evaluation was made for at least 10 chip resistors 100 in the same way. Results of evaluation of the solder heat resistance are shown in Tables 3A, 3B and 4. Notation of the results of evaluation is as follows:

○: crack, delamination or fracture was not observed;

Δ: 10% or less of samples showed crack, delamination or fracture; and x: more than 10% of samples showed crack, delamination or fracture.

4. Thermal Shock Resistance Under Thermal Cycling

For the evaluation, manufactured were 3216 size chip resistors 100 (rated 1 kΩ resistors) having the termination electrode layer 80 or the mixed materials of comparative examples. Each sample was produced by soldering the chip resistor onto copper electrode pads disposed on a glass epoxy substrate, using Sn—Ag(3%)-Cu(0.5%) lead free solder (model: VAPY LF219, from Arakawa Chemical Industries, Ltd.) in a nitrogen atmosphere, at a maximum temperature of about 240° C.

The samples were placed in a heat cycle tester with a liquid tank (liquid-to-liquid cold thermal shock chamber model TSB-51, from ESPEC Corporation), and exposed to 5000 cycles of temperature history repeated between low temperature side (−55° C., 30 min) and high temperature side (155° C., 30 min). In the evaluation, samples that caused 10% or more increase from the initial value in the resistivity were determined to be unacceptable. The evaluation was made for at least 150 samples in the same way. Results of evaluation of the thermal shock resistance under thermal cycling are shown in Tables 3A, 3B and 4. Notation of the results of evaluation is as follows:

○: zero unacceptable samples;

Δ: 20% or less unacceptable samples; and x: more than 20% unacceptable samples.

5. Die Shear Strength at Interface of Electroplated Layer/Termination Electrode Layer in Chip Resistor The present inventors evaluated temperature dependence of die shear strength (adhesion strength against shearing load) at the interface between the termination electrode layer 80 (a layer made of the mixed material) of this embodiment or the mixed materials of comparative examples, and the nickel plated layer. In the evaluation, each of the mixed materials that composes the termination electrode layer 80 or each of the mixed materials of comparative examples was applied by screen printing to the ceramic substrate, a nickel-plated silicon chip was placed on the coating, and then bonded by thermal curing at 175° C. for 15 minutes. The thus obtained sample was set on an ordinary die shear tester (model Series 4000PA2A, from Dage Precision Industries, Ltd.), and allowed to cause shear fracture while controlling the sample temperature on a hot plate, during which fracture strength was measured. Results of evaluation of the die shear strength are shown in Tables 3A, 3B and 4, in terms of "adhesion strength". Notation of the results of evaluation is as follows:

○: die shear strength is 4 $N/mm^2$ or more;

Δ: die shear strength is 2 $N/mm^2$ or more and less than 4 $N/mm^2$; and x: die shear strength is less than 2 $N/mm^2$.

Analyses of the results of evaluation of die shear strength revealed that the termination electrode layer 80 of this embodiment is less likely to cause degradation of die shear strength as compared with the mixed materials of comparative examples, in a high temperature region of 100° C. or more and 200° C. or less. More specifically, the termination electrode layer 80 was confirmed to have a die shear strength of 4 $N/mm^2$ or more in the aforementioned high temperature region. Hence, the termination electrode layer 80 was confirmed to retain a sufficient level of adhesion strength in terms of die shear strength particularly in the high temperature region.

6. Volume Resistivity

In the evaluation, each of the mixed materials that composes the termination electrode layer 80 or each of the mixed materials of comparative examples was printed through a stencil mask (about 35 mm long×about 22 mm wide×about 0.2 mm thick) onto a glass substrate (about 77 mm long×about 27 mm wide×about 1.5 mm thick). The printed glass substrate was placed in a thermostat chamber, and heated at 175° C. for 15 minutes so as to allow a solvent to vaporize and to thermally cure the mixed material. A cured product (electrode) was thus produced. The cured product was measured regarding specific resistivity at room temperature by a four-point-probe method. Results of evaluation of volume resistivity are shown in Tables 3A, 3B and 4. Note that the smaller the value, the better the electroconductivity of the cured product (electrode).

7. Evaluation of Voids

In the evaluation, each of the mixed materials that composes the termination electrode layer 80 or each of the mixed materials of comparative examples was printed through a stencil mask (about 35 mm long×about 22 mm wide×about 0.2 mm thick) onto a glass substrate (about 77 mm long×about 27 mm wide×about 1.5 mm thick). The printed glass substrate was placed in a thermostat chamber, and heated at 175° C. for 15 minutes so as to allow a solvent to vaporize and to thermally cure the mixed material. A cured product (electrode) was thus produced. The cured product was cut at a freely selected position, and the emerged cross-sectional surface was observed using an optical microscope (at a magnification of 200). The evaluation was made for at least three samples in the same way. Results of evaluation of voids are shown in Tables 3A, 3B and 4.

○: No voids were found in coating film;

Δ: several micro-voids were found in coating film; and x: considerably large voids, or 10 or more relatively large voids were found in coating film.

As described above, it becomes possible to realize the chip resistor 100 having high reliability even under harsh environments, by employing such termination electrode layer 80 of this embodiment. More specifically, the effects (1) to (3) below may be demonstrated:

(1) the chip resistor 100 can suppress thermal decomposition of the termination electrode layer 80, and can prevent or suppress generation of voids at the interface with the electroplated layer, or splashing of solder with a high degree of certainty;

(2) the chip resistor 100 can suppress or prevent delamination of the termination electrode layer 80 from the electroplated layer or the alumina substrate caused by load applied during solder bonding processes or heat cycle, and/or delamination or fracture inside the termination electrode layer or at solder bonded part, with a high degree of certainty; and (3) the chip resistor 100, when solder-bonded on a mounting board, can allow the termination electrode layer 80 to demonstrate a sufficient level of adhesion strength with the electroplated layer or the substrate, not only at normal temperature, but also under a low-temperature condition of −55° C. or less, or even under a high-temperature condition more than 150° C.

As described above, it becomes possible to realize the chip resistor 100 having high reliability even under harsh environments, by employing such termination electrode layer 80 of this embodiment. More specifically, the effects (1) to (3) below may be demonstrated:

(1) the chip resistor 100 can prevent or suppress generation of voids between the termination electrode layer 80 and the electroplated layer, or can prevent splashing of solder with a high degree of certainty;

(2) the chip resistor 100 can suppress or prevent delamination of the termination electrode layer 80 from the electroplated layer or the alumina substrate caused by load applied during solder bonding processes or heat cycle, with a high degree of certainty; and (3) the chip resistor 100, when solder-bonded on a mounting board, can allow the termination electrode layer 80 to demonstrate a sufficient level of adhesion strength with the electroplated layer or the substrate, not only at normal temperature, but also under a low-temperature condition of −55° C. or less, or even under a high-temperature condition more than 150° C.

EXAMPLES

The embodiment will be described below in further detail, referring to examples and comparative examples. These examples are, however, disclosed only for the purpose of illustrating the aforementioned embodiment, without restricting the embodiment. The numerical values of the individual components (individual starting materials) in examples and comparative examples are used to represent "part(s) by mass", and "%" means "mass %" except for the evaluation item "volume fraction".

<Preparation of Mixed Materials>

The mixed materials of the first embodiment shown in individual examples (1 to 22) and comparative examples (1 to 9) were manufactured as described below, as represented by Example 1. As described above, the termination electrode layer 80 in the first embodiment is made of such mixed material.

Using a kneader mixer, stirred and mixed were carbon (with a surface area per gram of 1200 $m^2$ or more), whisker-like particles made of silver-coated potassium titanate (with an average fiber diameter of about 0.3 an average fiber length of about 30 and an aspect ratio of about 60), flake-like particles made of silver with an average particle diameter of about 4 μm and an aspect ratio of 20 or more, a tetrafunctional hydroxyphenyl type epoxy resin with a number average molecular weight of about 620, an imidazole-based curing agent with an activation start temperature of about 130° C., and ethyl carbitol as a solvent, according to numbers of part of mixing for Example 1 in Tables 1A and 1B. The electrically-conductive particles were then allowed to disperse uniformly in the paste, using a triple roll mill.

The paste was then applied by the roller transfer method on both end faces of a 3216 size alumina substrate having preliminarily mounted thereon a resistive element of rated 1 kΩ, a metal electrode layer made of silver, and a protective film for the resistive element so as to form a coating film having a thickness after curing of about 20 μm at around the center of each end face. The coating film was then thermally cured in a drying oven at 175° C. for 15 minutes. The termination electrode layer was thus formed. On the termination electrode layer, formed were a nickel plated layer of about 15 μm thick, and further thereon a tin plated layer of about 50 μm thick, by electrolytic plating. A chip resistor was thus obtained.

Tables 1A and 1B show the individual components of the mixed materials in Examples 1 to 22. Meanwhile, Table 2 shows the individual components in Comparative Examples 1 to 9.

In more detail, Examples 2 to 11 represent the cases where ratio of the whisker-like particles to the flake-like particles, and the volume fraction of these particles in the layer made of the mixed material have been modified from those in Example 1. Components in Example 12 are same as those in Example 1, except that an imidazole-based curing agent with an activation start temperature of 110° C. or more (more specifically, with an activation start temperature of about 147° C.) but is different from that in Example 1 was used. Components in Example 13 are same as those in Example 1, except that a hydroxyphenyl-type epoxy resin having a molecular weight modified from that in Example 1 (a number average molecular weight of about 770) was used.

Components in Example 14 are same as those in Example 1, except that dicyandiamide as the curing agent and an imidazole-based curing agent as the curing catalyst (f) were used. Components in Examples 15 and 16 are same as those in Example 1, except that the curing catalyst (f) was used in addition to the components in Example 1. Components in Examples 17 to 22 are same as those in Example 1, except that Cu, Ni, Sn, Au, Pt, and solder (Sn-3Ag-0.5Cu alloy in this example) were respectively added as the electrically-conductive substance (a').

Comparative examples are as follows. Components in Comparative Example 1 are same as those in Example 1, except that carbon is not contained. Components in Comparative Examples 2 and 3 are same as those in Example 1, except that mass ratios of the flake-like particles are 9 or more (more specifically, 12) and less than 3/7 (more specifically, 0.24), respectively, when the whisker-like particles are assumed to be 1. Components in Comparative Example 4 are same as those in Example 1, except that a hydroxyphenyl-type epoxy resin with a number average molecular weight more than 800 (more specifically, with a number average molecular weight of about 1700) was employed. Components in Comparative Example 5 are same as those in Example 1, except that a bisphenol A-type epoxy resin (with a mass average molecular weight of about 50000), other than the hydroxyphenyl-type epoxy resin, was employed. Components in Comparative Example 6 are same as those in Example 1, except that a bisphenol A-type epoxy resin (with a mass average molecular weight of about 5500) and a novolac-type epoxy resin, other than the hydroxyphenyl-type epoxy resin, were employed. Components in Comparative Example 7 are same as those in Example 1, except that an imidazole-based curing agent with an activation start temperature less than 110° C. (more specifically, with an activation start temperature of 83° C.), which is different from that in Example 1, was used. Components in Comparative Example 8 are same as those in Example 1, except that a curing agent (for example, a phenol-type curing agent), different from the imidazole-based curing agent and dicyandiamide, was used. Components in Comparative Example 9 are same as those in Example 1, except that the volume fraction of the whisker-like particles and the flake-like particles, in the layer made of the mixed material, is more than 25% (more specifically, 27%).

Regarding each of the aforementioned examples and comparative examples, evaluated and analyzed were:

(i) solder heat resistance of the layer made of the mixed material (at 300° C. and 270° C.);

(ii) thermal shock resistance under thermal cycling, between −55° C. and 155° C., of the layer made of the mixed material;

(iii) adhesion strength at the interface between the layer made of the mixed material and the ceramic substrate, or between the layer made of the mixed material and the nickel plated layer, at 160° C. and 200° C.;

(iv) volume resistivity of the layer made of the mixed material; and (v) presence or absence of voids in the layer made of the mixed material.

Tables 1A, 1B, 3A, and 3B show results of the individual evaluations and analyses of the aforementioned examples. Tables 2 and 4 show results of the individual evaluations and analyses of the aforementioned comparative examples. The sample of Comparative Example 7 was thickened and gelated within a short time after produced, and neither measured nor evaluated.

TABLE 1A

| | Example 1 | Example 2 | Example 3 | Example 4 | Example 5 | Example 6 | Example 7 |
|---|---|---|---|---|---|---|---|
| Hydoxyphenyl-type epoxy resin (d) A | 100 | 100 | 100 | 100 | 100 | 100 | 100 |
| Hydroxyphenyl-type epoxy resin (d) B | 0 | 0 | 0 | 0 | 0 | 0 | 0 |
| Curing agent (e), imidazole-based A | 5 | 5 | 5 | 5 | 5 | 5 | 5 |
| Curing agent (e), imidazole-based B | 0 | 0 | 0 | 0 | 0 | 0 | 0 |
| Carbon (a) | 9 | 9 | 9 | 9 | 9 | 9 | 9 |
| Whisker-like particles (b) | 47 | 58 | 31 | 50 | 13 | 38 | 79 |
| Flake-like particles (c) | 110 | 135 | 126 | 250 | 115 | 57 | 79 |
| Ethyl carbitol | 73 | 73 | 73 | 73 | 73 | 73 | 73 |
| Total | 344 | 380 | 344 | 487 | 315 | 282 | 345 |
| Mass ratio of flake-like particles (whisker-like particles = 1) | 2.34 | 2.33 | 4.06 | 5.00 | 8.85 | 1.50 | 1.00 |
| Area fraction of (b) and (c) on outermost surface (%) | 39.5 | 40.2 | 51.6 | 61.0 | 47.6 | 32.5 | 36.1 |
| Spacing between contact points of (b) or (c) and nickel plating (μm) | 6.7 | 5.5 | 4.8 | 2.2 | 2.4 | 7.2 | 6.0 |
| Volume fraction of (b) + (c) (%) | 13.4 | 16.0 | 13.2 | 24.0 | 11.7 | 8.7 | 13.9 |
| Maximum elastic modulus in range from −55 to 155° C. (Pa) | $9.4 \times 10^7$ | $9.1 \times 10^7$ | $8.0 \times 10^7$ | $6.4 \times 10^7$ | $9.4 \times 10^7$ | $2.3 \times 10^8$ | $8.8 \times 10^7$ |
| Minimum elastic modulus in range from −55 to 155° C. (Pa) | $2.0 \times 10^7$ | $1.4 \times 10^7$ | $1.8 \times 10^7$ | $1.4 \times 10^7$ | $1.6 \times 10^7$ | $1.9 \times 10^7$ | $1.5 \times 10^7$ |
| 1 mass % Loss temperature (° C.) | 266 | 266 | 268 | 267 | 265 | 265 | 266 |

| | Example 8 | Example 9 | Example 10 | Example 11 | Example 12 | Example 13 |
|---|---|---|---|---|---|---|
| Hydoxyphenyl-type epoxy resin (d) A | 100 | 100 | 100 | 100 | 100 | 0 |
| Hydroxyphenyl-type epoxy resin (d) B | 0 | 0 | 0 | 0 | 0 | 100 |
| Curing agent (e), imidazole-based A | 5 | 5 | 5 | 5 | 0 | 5 |
| Curing agent (e), imidazole-based B | 0 | 0 | 0 | 0 | 5 | 0 |

TABLE 1A-continued

| | | | | | | |
|---|---|---|---|---|---|---|
| Carbon (a) | 9 | 9 | 9 | 9 | 9 | 9 |
| Whisker-like particles (b) | 90 | 73 | 97 | 43 | 47 | 47 |
| Flake-like particles (c) | 39 | 32 | 97 | 43 | 110 | 110 |
| Etkyl carbitol | 73 | 73 | 73 | 73 | 73 | 73 |
| Total | 316 | 292 | 381 | 273 | 344 | 344 |
| Mass ratio of flake-like particles (whisker-like particles = 1) | 0.43 | 0.44 | 1.00 | 1.00 | 2.34 | 2.34 |
| Area fraction of (b) and (c) no outermost surface(%) | 32.2 | 31.5 | 33.3 | 30.1 | 41.5 | 35.3 |
| Spacing between contact points of (b) or (c) and nickel plating(μm) | 8.1 | 9.1 | 3.3 | 9.6 | 4.4 | 7.0 |
| Volume fraction of (b) + (c) (%) | 12.0 | 10.0 | 16.5 | 8.0 | 13.4 | 13.4 |
| Maximum elastic modulus in range from −55 to 155° C. (Pa) | $9.1 \times 10^7$ | $9.4 \times 10^7$ | $9.3 \times 10^7$ | $9.9 \times 10^7$ | $8.6 \times 10^7$ | $9.0 \times 10^7$ |
| Minimum elastic modulus in range from −55 to 155° C. (Pa) | $1.5 \times 10^7$ | $1.7 \times 10^7$ | $1.4 \times 10^7$ | $2.0 \times 10^7$ | $1.4 \times 10^7$ | $2.3 \times 10^7$ |
| 1 mass % Loss temperature (° C.) | 271 | 266 | 267 | 269 | 265 | 269 |

TABLE 1B

| | Example 14 | Example 15 | Example 16 | Example 17 | Example 18 | Example 19 | Example 20 | Example 21 | Example 22 |
|---|---|---|---|---|---|---|---|---|---|
| Hydroxyphenyl-type epoxy resin (d) A | 108 | 100 | 100 | 100 | 100 | 100 | 100 | 100 | 100 |
| Hydroxyphenyl-type epoxy resin (d) B | 0 | 0 | 0 | 0 | 0 | 0 | 0 | 0 | 0 |
| Curing agent (e), imidazole-based A | 1 | 5 | 5 | 5 | 5 | 5 | 5 | 5 | 5 |
| Curing agent (e), imidazole-based B | 0 | 0 | 0 | 0 | 0 | 0 | 0 | 0 | 0 |
| Curing agent (e), dicyandiamide | 7 | 0 | 0 | 0 | 0 | 0 | 0 | 0 | 0 |
| Curing catalyst (f), Sn-based | 0 | 0.01 | 0 | 0 | 0 | 0 | 0 | 0 | 0 |
| Curing catalyst (f), P-based | 0 | 0 | 0.01 | 0 | 0 | 0 | 0 | 0 | 0 |
| Carbon (a) | 9 | 9 | 9 | 9 | 9 | 9 | 9 | 9 | 9 |
| Electrically-conductive substance (a'), Cu particles | 0 | 0 | 0 | 3 | 0 | 0 | 0 | 0 | 0 |
| Electrically-conductive substance (a'), Ni particles | 0 | 0 | 0 | 0 | 3 | 0 | 0 | 0 | 0 |
| Electrically-conductive substance (a'), Sn particles | 0 | 0 | 0 | 0 | 0 | 3 | 0 | 0 | 0 |
| Electrically-conductive substance (a'), An particles | 0 | 0 | 0 | 0 | 0 | 0 | 3 | 0 | 0 |

TABLE 1B-continued

| | Example 14 | Example 15 | Example 16 | Example 17 | Example 18 | Example 19 | Example 20 | Example 21 | Example 22 |
|---|---|---|---|---|---|---|---|---|---|
| Electrically-conductive substance (a'), Pt particles | 0 | 0 | 0 | 0 | 0 | 0 | 0 | 3 | 0 |
| Electrically-conductive substance (a'), Sn—3Ag—0.5Cu particles | 0 | 0 | 0 | 0 | 0 | 0 | 0 | 0 | 3 |
| Whisker-like particles (b) | 47 | 47 | 47 | 47 | 47 | 47 | 47 | 47 | 47 |
| Flake-like particles (c) | 110 | 110 | 110 | 110 | 110 | 110 | 110 | 110 | 110 |
| Ethyl carbitol | 73 | 73 | 73 | 73 | 73 | 73 | 73 | 73 | 73 |
| Total | 347 | 344.01 | 344.01 | 347 | 347 | 347 | 347 | 347 | 347 |
| Mass ratio of flake-like particles (whisker-like particles = 1) | 2.34 | 2.34 | 2.34 | 2.34 | 2.34 | 2.34 | 2.34 | 2.34 | 2.34 |
| Area fraction of (b) and (c) on outermost surface (%) | 42.5 | 40.7 | 40.5 | 39.8 | 40.0 | 39.6 | 39.5 | 39.6 | 40.0 |
| Spacing between contact points of (b) or (c) and nickel plating (μm) | 5.7 | 6.4 | 6.5 | 6.7 | 6.6 | 6.8 | 6.6 | 6.6 | 6.5 |
| Volume fraction of (b) + (c) (%) | 13.4 | 13.4 | 13.4 | 13.4 | 13.4 | 13.4 | 13.4 | 13.4 | 13.4 |
| Maximum elastic modulus in range from −55 to 155° C. (Pa) | $3.5 \times 10^8$ | $1.1 \times 10^8$ | $1.5 \times 10^8$ | $9.3 \times 10^7$ | $9.3 \times 10^7$ | $9.4 \times 10^8$ | $9.2 \times 10^7$ | $9.2 \times 10^7$ | $9.4 \times 10^7$ |
| Minimum elastic modulus in range from −55 to 155° C. (Pa) | $3.3 \times 10^7$ | $2.5 \times 10^7$ | $2.8 \times 10^7$ | $2.0 \times 10^7$ | $1.9 \times 10^7$ | $2.0 \times 10^7$ | $2.0 \times 10^7$ | $1.9 \times 10^7$ | $2.1 \times 10^7$ |
| 1 mass % Loss temperature (° C.) | 275 | 270 | 272 | 267 | 266 | 265 | 267 | 268 | 262 |

TABLE 2

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|
| Hydroxyphenyl-type epoxy resin (d) A | 108 | 100 | 100 | 0 | 0 | 0 | 100 | 100 | 100 |
| Hydroxyphenyl-type epoxy resin (d) B | 0 | 0 | 0 | 0 | 0 | 0 | 0 | 0 | 0 |
| Hydroxyphenyl-type epoxy resin (d) C | 0 | 0 | 0 | 100 | 0 | 0 | 0 | 0 | 0 |
| Bisphenol A-type epoxy resin D | 0 | 0 | 0 | 0 | 100 | 0 | 0 | 0 | 0 |
| Bisphenol A-type epoxy resin E | 0 | 0 | 0 | 0 | 0 | 50 | 0 | 0 | 0 |
| Novolac-type epoxy resin F | 0 | 0 | 0 | 0 | 0 | 50 | 0 | 0 | 0 |
| Imidazole-based curing agent (e) A | 5 | 5 | 5 | 5 | 5 | 5 | 0 | 0 | 5 |
| Imidazole-based curing agent (e) B | 0 | 0 | 0 | 0 | 0 | 0 | 0 | 0 | 0 |
| Imidazole-based curing agent C | 0 | 0 | 0 | 0 | 0 | 0 | 5 | 0 | 0 |
| Curing agent D | 0 | 0 | 0 | 0 | 0 | 0 | 0 | 5 | 0 |
| Carbon (a) | 0 | 9 | 9 | 9 | 9 | 9 | 9 | 9 | 9 |

TABLE 2-continued

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|
| Whisker-like particles (b) | 47 | 10 | 127 | 47 | 38 | 26 | 47 | 47 | 102 |
| Flake-like particles (c) | 110 | 120 | 31 | 110 | 88 | 60 | 110 | 110 | 238 |
| Ethyl carbitol | 73 | 73 | 73 | 73 | 73 | 73 | 73 | 73 | 73 |
| Total | 335 | 317 | 345 | 344 | 344 | 344 | 344 | 344 | 527 |
| Mass ratio of flake-like particles (whisker-like particles = 1.) | 2.34 | 12.0 | 0.24 | 2.34 | 2.34 | 2.34 | 2.34 | 2.34 | 234 |
| Area fraction of (b) and (c) on outermost surface (%) | 38.9 | 43.2 | 26.0 | 24.2 | 21.2 | 9.6 | | 38.0 | 37.5 |
| Spacing between contact points of (b) or (c) and nickel plating (μm) | 4.9 | 3.7 | 10.3 | 10.6 | 11.6 | 13.8 | | 5.5 | 3.6 |
| Volume fraction of (b) + (c) (%) | 13.4 | 11.8 | 13.5 | 13.4 | 13.4 | 13.4 | | 13.4 | 27.0 |
| Maximum elastic modulus in range from −55 to 155° C. (Pa) | $8.8 \times 10^7$ | $8.0 \times 10^7$ | $8.1 \times 10^7$ | $7.4 \times 10^7$ | $9.0 \times 10^7$ | $1.8 \times 10^8$ | | $5.2 \times 10^7$ | $2.0 \times 10^7$ |
| Minimum elastic modulus in range from −55 to 155° C. (Pa) | $1.4 \times 10^7$ | $1.8 \times 10^7$ | $1.2 \times 10^7$ | $9.7 \times 10^6$ | $1.4 \times 10^6$ | $3.6 \times 10^6$ | | $7.5 \times 10^6$ | $7.4 \times 10^6$ |
| 1 mass % Loss temperature (° C.) | 268 | 266 | 266 | 287 | 270 | 243 | | 258 | 267 |

(Note)
The sample of Comparative Example 7 was thickened or gelated within a short time after manufacture, and was not measured.

TABLE 3A

| | Example 1 | Example 2 | Example 3 | Example 4 | Example 5 | Example 6 | Example 7 |
|---|---|---|---|---|---|---|---|
| Solder heat resistance at 300° C. | ○ | ○ | ○ | ○ | ○ | Δ | ○ |
| Solder heat resistance at 270° C. | ○ | ○ | ○ | ○ | ○ | ○ | ○ |
| Thermal shock resistance under thermal cycling between −55° C. and 155° C. | ○ | ○ | ○ | Δ | ○ | ○ | ○ |
| Adhesion strength at 160° C. | ○ | ○ | ○ | ○ | ○ | ○ | ○ |
| Adhesion strength at 200° C. | ○ | ○ | ○ | ○ | ○ | Δ | ○ |
| Volume resistivity (Ω cm) | $2.3 \times 10^{-4}$ | $1.1 \times 10^{-4}$ | $1.4 \times 10^{-4}$ | $8.9 \times 10^{-6}$ | $1.4 \times 10^{-3}$ | $6.9 \times 10^{-4}$ | $2.3 \times 10^{-4}$ |
| Voids in coating film | ○ | ○ | ○ | ○ | ○ | ○ | ○ |

| | Example 8 | Example 9 | Example 10 | Example 11 | Example 12 | Example 13 |
|---|---|---|---|---|---|---|
| Solder heat resistance at 300° C. | Δ | Δ | ○ | Δ | ○ | ○ |
| Solder heat resistance at 270° C. | ○ | ○ | ○ | Δ | ○ | ○ |
| Thermal shock resistance under thermal cycling between −55° C. and 155° C. | ○ | ○ | ○ | ○ | ○ | ○ |

TABLE 3A-continued

| | | | | | | |
|---|---|---|---|---|---|---|
| Adhesion strength at 160° C. | ○ | ○ | ○ | ○ | ○ | ○ |
| Adhesion strength at 200° C. | ○ | ○ | ○ | Δ | ○ | ○ |
| Volume resistivity (Ω cm) | $1.4 \times 10^{-4}$ | $5.7 \times 10^{-4}$ | $1.4 \times 10^{-4}$ | $1.8 \times 10^{-3}$ | $1.3 \times 10^{-4}$ | $3.2 \times 10^{-4}$ |
| Voids in coating film | ○ | ○ | ○ | ○ | ○ | ○ |

TABLE 3B

| | Example 14 | Example 15 | Example 16 | Example 17 | Example 18 | Example 19 | Example 20 | Example 21 | Example 22 |
|---|---|---|---|---|---|---|---|---|---|
| Solder heat resistance at 300° C. | ○ | ○ | ○ | ○ | ○ | ○ | ○ | ○ | ○ |
| Solder heat resistance at 270° C. | ○ | ○ | ○ | ○ | ○ | ○ | ○ | ○ | ○ |
| Thermal shock resistance under thermal cycling between −55° C. and 155° C. | ○ | ○ | ○ | ○ | ○ | ○ | ○ | ○ | ○ |
| Adhesion strength at 160° C. | ○ | ○ | ○ | ○ | ○ | ○ | ○ | ○ | ○ |
| Adhesion strength at 200° C. | ○ | ○ | ○ | ○ | ○ | ○ | ○ | ○ | ○ |
| Volume resistivity (Ω cm) | $6.1 \times 10^{-4}$ | $2.1 \times 10^{-4}$ | $2.0 \times 10^{-6}$ | $2.8 \times 10^{-6}$ | $3.2 \times 10^{-3}$ | $3.0 \times 10^{-4}$ | $1.7 \times 10^{-4}$ | $1.8 \times 10^{-4}$ | $2.9 \times 10^{-4}$ |
| Voids in coating film | ○ | ○ | ○ | ○ | ○ | ○ | ○ | ○ | ○ |

TABLE 4

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|
| Solder heat resistance at 300° C. | X | X | X | X | X | X | | X | X |
| Solder heat resistance at 270° C. | X | X | X | X | X | X | | X | Δ |
| Thermal shock resistance under thermal cycling between −55° C. and 155° C. | Δ | Δ | Δ | Δ | X | X | | X | Δ |
| Adhesion strength at 160° C. | Δ | X | Δ | Δ | X | Δ | | Δ | Δ |
| Adhesion strength at 200° C. | X | X | X | X | X | Δ | | Δ | X |
| Volume resistivity | $8.2 \times 10^{-3}$ | $5.4 \times 10^{-3}$ | $1.7 \times 10^{-4}$ | $2.1 \times 10^{-4}$ | $6.7 \times 10^{-4}$ | $4.4 \times 10^{-3}$ | | $2.8 \times 10^{-4}$ | $9.1 \times 10^{-6}$ |
| Voids in coating film | ○ | ○ | X | ○ | ○ | ○ | | Δ | ○ |

(Note)
The sample of Comparative Example 7 was thickened or gelated within a short time after manufacture, and was not measured.

As can be understood from Tables 1A, 1B, 3A and 3B, with the termination electrode layer of this embodiment, it becomes possible to realize the chip resistor 100 having high reliability even under harsh environments.

Note that the aforementioned embodiment and examples were disclosed for the purpose of illustrating such embodiment and examples, without restricting the present invention. Moreover, any modified examples that include other combinations of the aforementioned embodiment and fall within the scope of the present invention are understood to be embraced by the claims.

INDUSTRIAL APPLICABILITY

The chip-shaped electronic component of the aforementioned embodiment may be used mainly as an electronic component or a part of the same.

The invention claimed is:

1. A chip-shaped electronic component comprising:
a substrate; and
a termination electrode layer on an end face of the substrate,
wherein the termination electrode layer is made of a mixed material that contains:
an electrically-conductive substance (a') containing carbon (a) as one type of the electrically-conductive substance (a'),
whisker-like particles (b) covered with the electrically-conductive substance (a'),
flake-like particles (c) having electroconductivity, and
a tetrafunctional hydroxyphenyl type epoxy resin (d) having a molecular weight of 450 or more and less than 800, and
a mass ratio of the flake-like particles (c) is 3/7 or more and 9 or less when the whisker-like particles (b) is assumed to be 1;
wherein when the termination electrode layer is observed by scanning electron microscopy (SEM) at a magnification of 1500, the termination electrode layer includes a region in which an area fraction of a section where the whisker-like particles (b) exposed on an outermost surface of the termination electrode layer and the flake-like particles (c) exposed on the outermost surface of the termination electrode layer is 30% or more seen in a 0.075 mm×0.057 mm randomly selected area of the termination electrode layer.

2. A chip-shaped electronic component comprising:
a substrate; and
a termination electrode layer on an end face of the substrate,
wherein the termination electrode layer is made of a mixed material that contains:
an electrically-conductive substance (a') containing carbon (a) as one type of the electrically-conductive substance (a'),
whisker-like particles (b) covered with the electrically-conductive substance (a'),
flake-like particles (c) having electroconductivity, and
a tetrafunctional hydroxyphenyl type epoxy resin (d) having a molecular weight of 450 or more and less than 800, and
a mass ratio of the flake-like particles (c) is 3/7 or more and 9 or less when the whisker-like particles (b) is assumed to be 1;
wherein when the termination electrode layer is observed by cross-sectional scanning electron microscopy (SEM) at a magnification of 1000, the termination electrode layer includes a region in which a spacing between contact points of the whisker-like particles (b) exposed on an outermost surface of the termination electrode layer or the flake-like particles (c) exposed on the outermost surface of the termination electrode layer and an electroplated layer included in the chip-shaped electronic component is 10 μm or less seen in a 0.125 mm×0.034 mm randomly selected area of the termination electrode layer.

3. A chip-shaped electronic component comprising:
a substrate; and
a termination electrode layer on an end face of the substrate,
wherein the termination electrode layer is made of a mixed material that contains:
an electrically-conductive substance (a') containing carbon (a) as one type of the electrically-conductive substance (a'),
whisker-like particles (b) covered with the electrically-conductive substance (a'),
flake-like particles (c) having electroconductivity, and
a tetrafunctional hydroxyphenyl type epoxy resin (d) having a molecular weight of 450 or more and less than 800, and
a mass ratio of the flake-like particles (c) is 3/7 or more and 9 or less when the whisker-like particles (b) is assumed to be 1;
wherein a volume fraction of the whisker-like particles (b) and the flake-like particles (c) in the termination electrode layer is 7% or more and 25% or less.

4. A chip-shaped electronic component comprising:
a substrate; and
a termination electrode layer on an end face of the substrate,
wherein the termination electrode layer is made of a mixed material that contains:
an electrically-conductive substance (a') containing carbon (a) as one type of the electrically-conductive substance (a'),
whisker-like particles (b) covered with the electrically-conductive substance (a'),
flake-like particles (c) having electroconductivity, and
a tetrafunctional hydroxyphenyl type epoxy resin (d) having a molecular weight of 450 or more and less than 800, and
a mass ratio of the flake-like particles (c) is 3/7 or more and 9 or less when the whisker-like particles (b) is assumed to be 1;
wherein the termination electrode layer has a storage modulus of $10^7$ Pa or more and $10^{10}$ Pa or less in a temperature range from −55° C. or more and 155° C. or less.

5. The chip-shaped electronic component according to claim 4, wherein the electrically-conductive substance (a') contains at least one substance selected from the group consisting of Ag, Cu, Ni, Sn, Au, Pt, solder, and the carbon (a).

6. The chip-shaped electronic component according to claim 5, further comprising a curing agent (e) and a curing catalyst (f).

7. The chip-shaped electronic component according to claim 5, wherein when the termination electrode layer is observed by scanning electron microscopy (SEM) at a magnification of 1500, the termination electrode layer includes a region in which an area fraction of a section where the whisker-like particles (b) exposed on an outermost surface of the termination electrode layer and the flake-like particles (c) exposed on the outermost surface of the termination electrode layer is 30% or more seen in a 0.075 mm×0.057 mm randomly selected area of the termination electrode layer.

8. The chip-shaped electronic component according to claim 5, wherein when the termination electrode layer is observed by cross-sectional scanning electron microscopy (SEM) at a magnification of 1000, the termination electrode layer includes a region in which a spacing between contact points of the whisker-like particles (b) exposed on an outermost surface of the termination electrode layer or the flake-like particles (c) exposed on the outermost surface of the termination electrode layer and an electroplated layer included in the chip-shaped electronic component is 10 μm or less seen in a 0.125 mm×0.034 mm randomly selected area of the termination electrode layer.

9. The chip-shaped electronic component according to claim 5, wherein a volume fraction of the whisker-like particles (b) and the flake-like particles (c) in the termination electrode layer is 7% or more and 25% or less.

10. The chip-shaped electronic component according to claim 5, wherein the termination electrode layer has a 1 mass % loss temperature, in resin equivalent, of 250° C. or more.

11. The chip-shaped electronic component according to claim 4, further comprising a curing agent (e) and a curing catalyst (f).

12. The chip-shaped electronic component according to claim 11, wherein when the termination electrode layer is observed by scanning electron microscopy (SEM) at a magnification of 1500, the termination electrode layer includes a region in which an area fraction of a section where the whisker-like particles (b) exposed on an outermost surface of the termination electrode layer and the flake-like particles (c) exposed on the outermost surface of the termination electrode layer is 30% or more seen in a 0.075 mm×0.057 mm randomly selected area of the termination electrode layer.

13. The chip-shaped electronic component according to claim 11, wherein when the termination electrode layer is observed by cross-sectional scanning electron microscopy (SEM) at a magnification of 1000, the termination electrode layer includes a region in which a spacing between contact points of the whisker-like particles (b) exposed on an outermost surface of the termination electrode layer or the flake-like particles (c) exposed on the outermost surface of the termination electrode layer and an electroplated layer included in the chip-shaped electronic component is 10 μm or less seen in a 0.125 mm×0.034 mm randomly selected area of the termination electrode layer.

14. The chip-shaped electronic component according to claim 11, wherein a volume fraction of the whisker-like particles (b) and the flake-like particles (c) in the termination electrode layer is 7% or more and 25% or less.

15. The chip-shaped electronic component according to claim 11, wherein the termination electrode layer has a 1 mass % loss temperature, in resin equivalent, of 250° C. or more.

16. The chip-shaped electronic component according to claim 4, wherein the curing agent (e) is an imidazole-based curing agent excluding those having a triazine skeleton, the imidazole based curing agent having an activation start temperature of 110° C. or more, and/or dicyandiamide.

* * * * *